US005576522A

United States Patent [19]

Taso

[11] Patent Number: 5,576,522

[45] Date of Patent: Nov. 19, 1996

[54] TUBE-ANNEXED SPEAKER CABINET

[76] Inventor: Ye M. Taso, Basement, No. 4, Lane 137, Wanta Rd., Taipei, Taiwan

[21] Appl. No.: 377,893

[22] Filed: Jan. 24, 1995

[51] Int. Cl.[6] ..... A47B 81/06

[52] U.S. Cl. ..... 181/199; 181/156

[58] Field of Search ..... 181/152, 153, 181/156, 199; 381/88, 188, 205

[56] References Cited

U.S. PATENT DOCUMENTS

| | | | |
|---|---|---|---|
| 3,945,461 | 3/1976 | Robinson | 181/199 X |
| 4,616,731 | 10/1986 | Robinson | 181/199 X |
| 5,082,084 | 1/1992 | Ye-Ming | 181/199 X |
| 5,173,575 | 12/1992 | Furukawa | 181/156 X |

*Primary Examiner*—Khanh Dang
*Attorney, Agent, or Firm*—Pro-Techtor International

[57] ABSTRACT

A tube-annexed speaker cabinet has a connecting device disposed on an opening at the bottom wall. A tube assembly which composes of one or more than one tubes engages with the connecting device. The other end of tube assembly engages with a pedestal which is a platform or a hollow box to support the cabinet from falling. A venting hole is optionally disposed on the bottom wall and each said wall of the hollow box and on the tube assembly respectively. A horizontal platform and a friction pad are disposed on the upper end of tube assembly to hold the cabinet. Tube assembly and pedestal box expands the volume of cabinet. Speaker cabinet can also be disposed on the rear shelf of car trunk with tube assembly extending downward into the trunk. The bottom wall of tube assembly is close or has a venting hole formed therein. Thus forming an increase interior volume of speaker cabinet to generate better resonant effect. Furthermore, reflecting tube can be disposed on the back of the cabinet to enhance low frequency effect of the cabinet. Whereby to expand resonant means, to reduce resonance and over focused reflection of the cabinet, to decrease low frequency distortion, to eliminate back wave and to enhance sound quality.

6 Claims, 5 Drawing Sheets

TUBE-ANNEXED SPEAKER CABINET

BACKGROUND OF THE INVENTION

1. Field of the Invention

This invention relates to a speaker cabinet, and more particularly is a cabinet that has at least one auxiliary tubular device attached to it.

2. Description of the Prior Art

Previously, speakers, especially those of hi-fi class, in order to take advantage of the resonating effects of big cabinets, are generally made in rectangular shapes. Big cabinets, although so widely used, have disadvantages rarely known by users, such as the resonance generated by the cabinet body itself and an over-focused reflection. Small cabinets, on the other hand, may suffer shortcomings at lower frequency and a special distortion caused by the-wave within the cabinet. Facing these problems, numerous versions of new speakers have been introduced to the hi-fi world during the past 20 years. Yet, unfortunately, due to the lack of knowledge on principles of physics and sound waves, revolutionary breakthroughs have been rarely made by speaker designers.

The inventor, through 20 years' research and manufacturing, has ultimately come up with a revolutionary design based on the tubular device disclosed hereinafter.

Speakers used for automobile hi-fi systems today are nearly all installed at the inner-wall of the trunk. Nearly all improvements in car stereos, aimed at improving the sonic effects, are focused on the speaker units themselves. As the size and the shape of the speaker cabinets can hardly be modified due to the limited size and the fixed interior shape of cars in general, people can only accept them as they are. A new type of gun-shaped cabinet, however, although it can be connected to the trunk wall, can have little improving effect due to its exclusive focus on low-frequency. In view of these factors, the inventor accomplished a long-desired goals by creating an unprecedented design for speaker cabinets.

SUMMARY OF THE INVENTION

It is the main purpose of this invention to provide a tube-annexed speaker cabinet to which a tube is connected and firmly fixed to the cabinet body. The connecting tube, while servicing as an auxiliary device, also functions as a speaker stand that supports the speaker cabinet. The top end of the tube is connected to the cabinet by way of a connecting device. The bottom end of the tube is connected to a pedestal or to a hollow box.

It is a secondary purpose of this invention to provide a cabinet with a tubular auxiliary device. The deice can function as a cabinet stand which is connected to the cabinet it supports at the bottom of the cabinet. The cabinet, similar to a customary one, has a hole at its bottom, A connecting device is provided for the hole such that a tube, or a tube assembly having a diameter corresponding to that of the hole or the connecting device provided therewith, can be easily and conveniently fixed to the cabinet. Said tube assembly can be one single tube, or have a number of sections that are assembled to act as one single tube. The bottom of the tube assembly is connected to a platform or a box in a similar manner as it is connected to the cabinet. Such platform or box must be thick or heavy enough so that, when connected with the cabinet and the tube assembly as a speaker unit, it does not fall easily. Holes are provided in the box at its bottom and sides, and to the tube assembly at a box wall. In order to further stabilize the speaker unit, a platform may be provided between the connecting device and the top of the tube assembly for reinforcement. Thus, the unit, containing a speaker cabinet, a tubular assembly, and a platform or a box, would act as a larger cabinet. The effective volume of the original cabinet is thus increased, so that the cabinet resonance and the distortion on the low frequencies are lowered, the reflection becomes less focused, the back-wave is eliminated, and the sound quality is thus upgraded.

DETAILED DESCRIPTION OF THE PREFERRED EMBODIMENT

Figure 1:
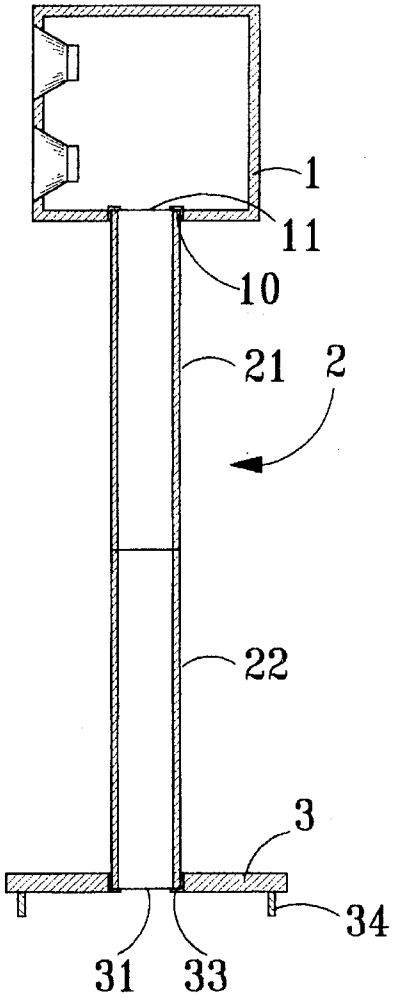
FIG. 1 is a cross-sectional view of the first embodiment of the invention.

FIGS. 1 through 6 show cross-sectional views of the embodiments of the present invention as a tube-annexed speaker cabinet. These embodiments have the auxiliary tubular part amounted on their bottom. The first embodiment, shown in FIG. 1, provides a hole 11 in a typical cabinet 1 at its bottom. A connected device 10 is provided for the hole. A tube assembly 2 consists of a plurality of tube sections fitted together. The upper end of the upper tube 21 is mounted to the connecting device 10, whereas the lower end of the lower tube 22 is mounted to a connecting device 33 on the supporting pedestal 3. In this embodiment, the pedestal 3 is a plate thick enough to support the whole speaker assembly. The connecting device 33 has an opening 31 which acts as a venting opening, allowing air to go in and out of the tube assembly 2.

Figure 2:
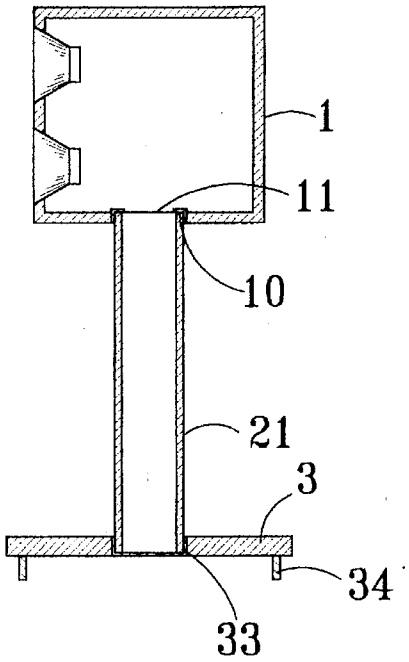
FIG. 2 is a cross-sectional view of the second embodiment of the invention.

The second embodiment shown in FIG. 2 differs from the first one in that its connecting device 33 is closed, without opening 31, and prohibits air from flowing in or out.

Figure 3A:
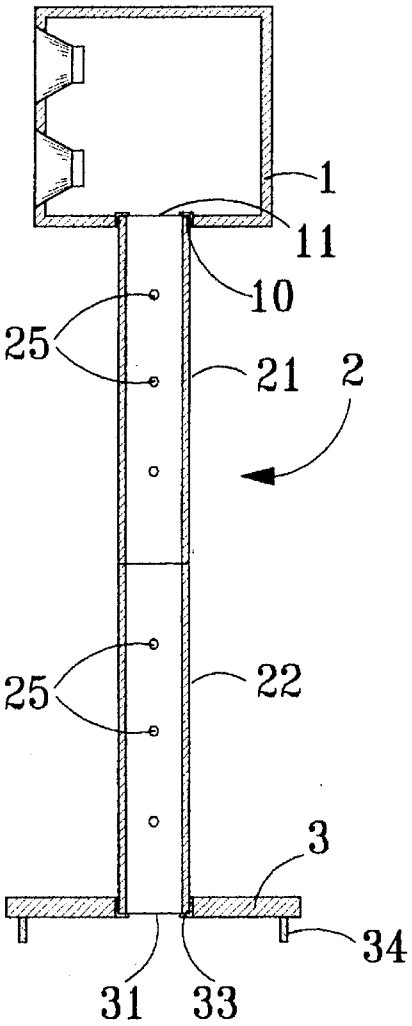
FIG. 3A is a cross-sectional view of the third embodiment with multiple tube
Figure 3:
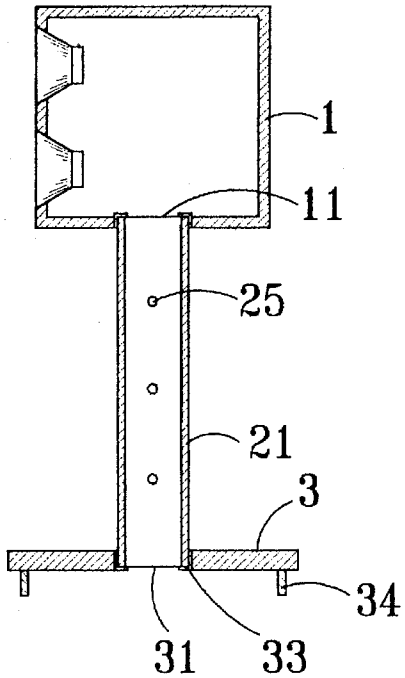
FIG. 3 is a cross-sectional view of the third embodiment of the invention.

FIG. 3, which represents the third embodiment, shows a different form of tube by including a plurality of small holes 25 formed on the wall of tube 21. Four heels 34 are mounted on the bottom of pedestal 3 to stabilize the pedestal.

Figure 4:
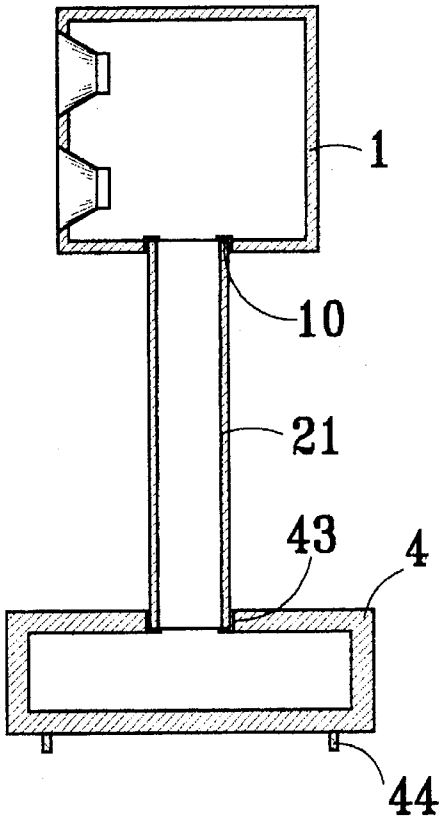
FIG. 4 is a cross-sectional view of the fourth embodiment of the invention.

The fourth embodiment, shown in FIG. 4, utilizes a box 4 in place of the plate pedestal 3. The box 4 forms a closed space, and is provided with a connecting device 43 at its top surface for mounting of the tube 21. Four heels 44 are mounted on the bottom of the box 4 to stabilize the unit.

Figure 5:
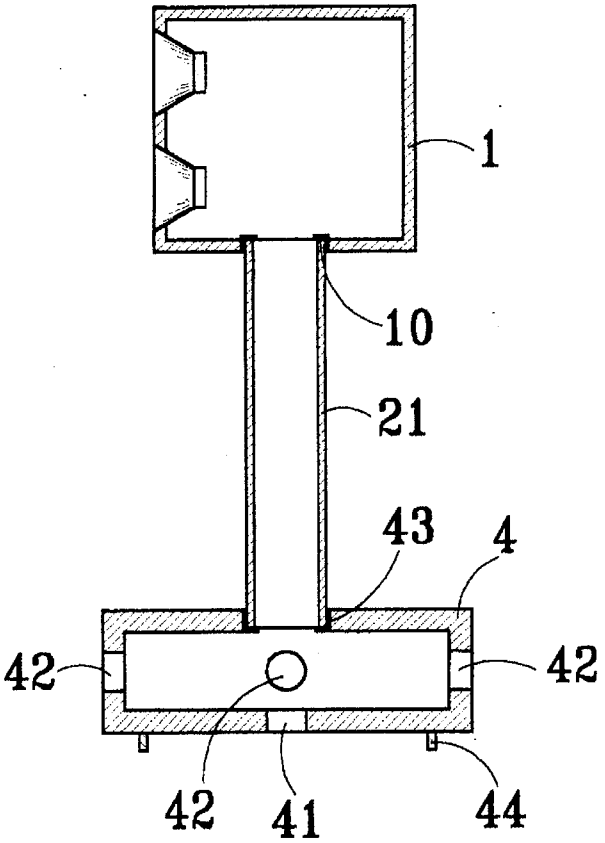
FIG. 5 is a cross-sectional view of the fifth embodiment of the invention.

The fifth embodiment shown in FIG. 5, is very similar to the fourth embodiment, but has holes 41 and 42 formed on the side wall and bottom wall of the pedestal box 4*a*. the holes 41, 42 allow air to flow in and out of the box 4.

Figure 6:
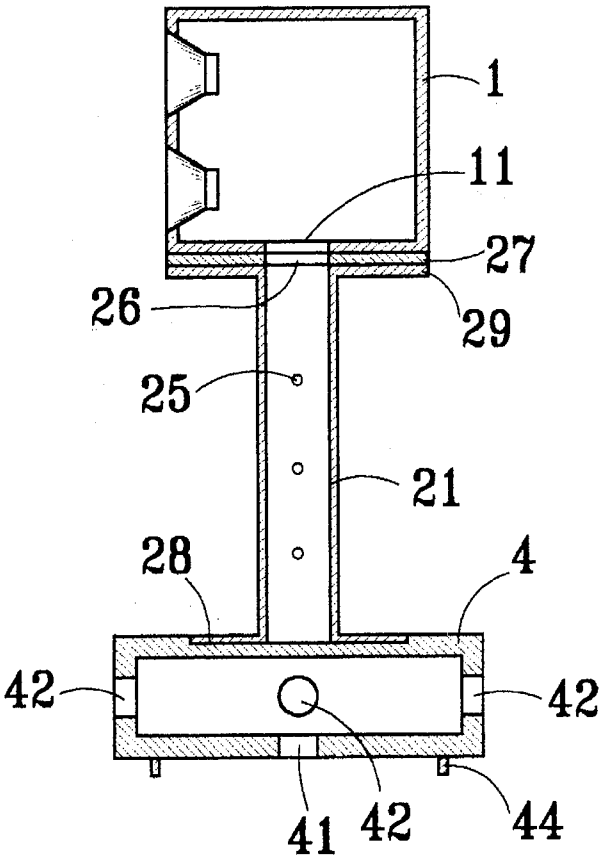
FIG. 6 is a cross-sectional view of the sixth embodiment of the invention.

The sixth embodiment, shown in FIG. 6, is provided with small additional holes 25 a the wall of its tube 21. At the top or bottom of the said tube 21, reinforcing plates 28 and 29 may be mounted to further stabilize the speaker unit. In addition to the aforementioned mounting method, a rubber pad 27 with a hole 26 at its center may be placed between the speaker cabinet 1 and the plate 29 with its hole 26 in line with the cabinet hole 11 and the opening of the tube 21 to provide a necessary friction. Thus, the cabinet can be easily moved and installed.

The invention, as disclosed above, can effectively extend the volume of the speaker cabinet. The volume of the cabinet, by using an added tube assembly, is no longer limited to the cabinet per se. Therefore the resonance and the focused back wave existing in standard rectangular cabinets will thus be greatly reduced, lower frequency distortion will be reduces, back wave will be eliminated, thereby improving overall sound quality and resolving the disadvantages of conventional cabinets. The invention, by applying a new restructuring pneumatic and acoustic wave mechanism, resolves the issues not yet being addressed by conventional speaker cabinets, and achieves an unprecedented structure and effect.

Figure 9:
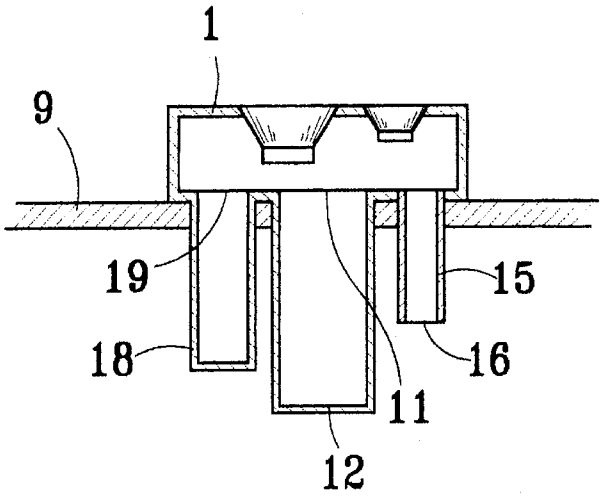
FIG. 9 is a cross-sectional view of the ninth embodiment of the invention.
Figure 8:
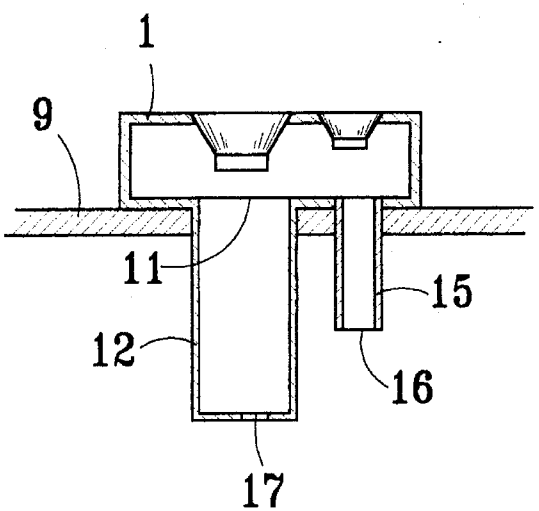
FIG. 8 is a cross-sectional view of the eighth embodiment of the invention.
Figure 7:
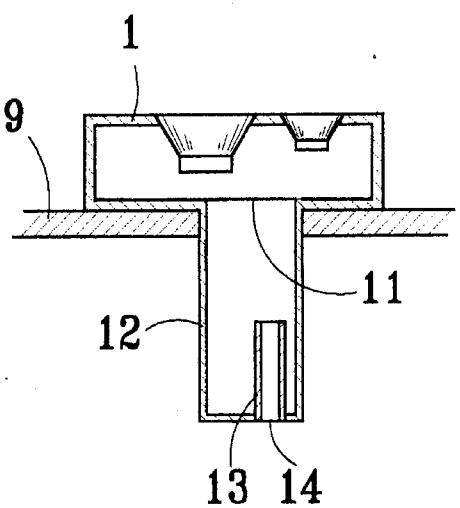
FIG. 7 is a cross-sectional view of the seventh embodiment of the invention.

FIGS. 7 through 9 show three more embodiments of the invention. In these embodiments, tubes are firmly inserted into each cabinet. FIG. 7 shows the 7th embodiment of the invention having a tube 12 inserted into the cabinet at the opening 11. A small reflecting tube 13 is fixed on the bottom of tube 12, and an opening 14 is provided at the end of said reflecting tube 13.

The eight embodiment shown in FIG. 8 has two openings on the back of the cabinet 1. A tube 12 is fixed to the big opening 11, whereas a smaller reflecting tube 15 is affixed to the smaller opening. An opening 16 is provided at the end of reflecting tube 15. Tube 12 is either a tube with no opening at its end, or a tube with a small venting hole 17 at its end.

The ninth embodiment shown in FIG. 9 shows a cabinet 1 with a number of holes on its back. Two tubes 18 and 12 are fixed respectively to the holes 19 and 11. A reflecting tube 15 having an opening 16 is fixed to the third hole on the back of the cabinet 1. None of these embodiments have tubes mounted on the back that are long enough to infringe on the trunk space of the car. The tubes, as a device extending the cabinet space, substantially increase the cabinet volume, and improve the resonant effect at low frequencies. The openings can not only help vent air, but also improve the sensitivity of the speaker at low frequencies. Multiple tubes will substantially increase the cabinet volume and obtain better sound quality. Cabinet 1 is set at a suitable location on a stationary means such as the rear shelf 9 above the trunk of an automobile. The tubes can be made integrally with the cabinet or be made separately, and affixed to the cabinet. Tubes of different sizes can also be chosen to fit the volume and the shape of the trunk.

Figure 12:
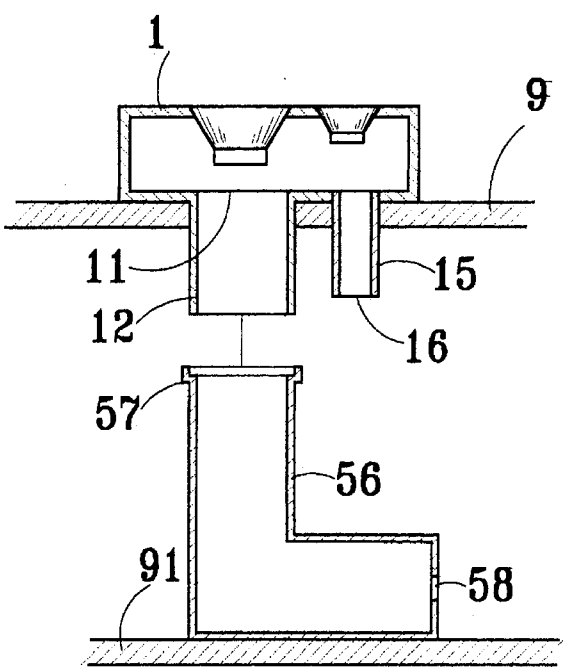
FIG. 12 is a cross-sectional view of the twelfth embodiment of the invention.
Figure 11:
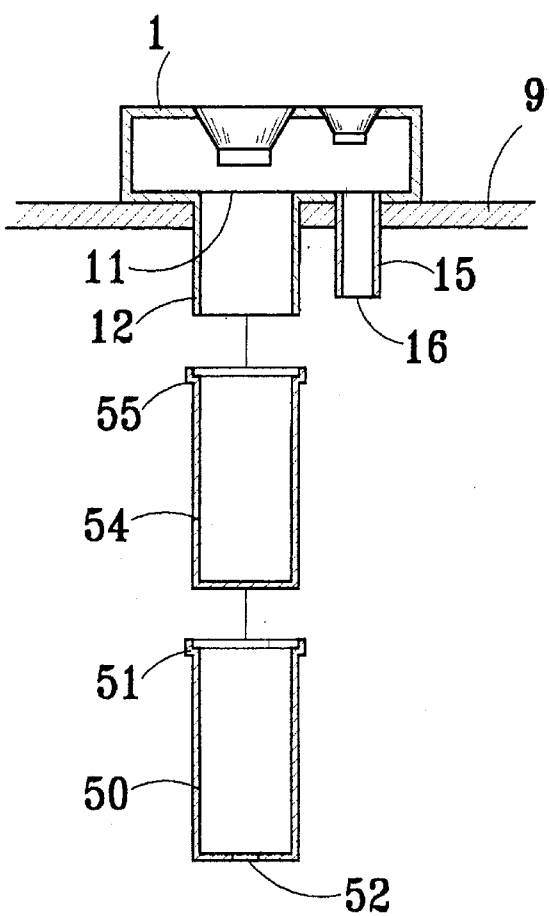
FIG. 11 is a cross-sectional view of the eleventh embodiment of the invention.
Figure 10:
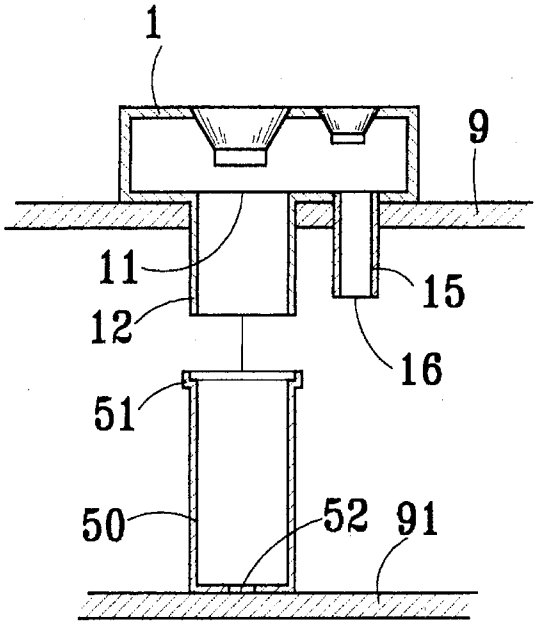
FIG. 10 is a cross-sectional view of the tenth embodiment of the invention.

FIG. 10 through 12 show three further embodiments of embedded-type cabinets of the present invention. The speaker cabinet shown in FIG. 10 has one extension tube 12 and one reflecting tube 15. An opening 16 is provided at the end of the tube 15. The extension tube 12 has its lower opening connecting with an engaging opening 51 of a base tube 50. Base tube 50 is extended and fixed on the bottom wall 91 of a stationary means such as the floor of a car trunk. The bottom of base tube 50 is either closed or has a venting hole 52.

The eleventh embodiment shown in FIG. 11 shows an embodiment with one or more intermediate tubes 54 disposed between speaker cabinet 1 and base tube 50. Each intermediate tube 54 has an engaging opening 55 for connecting with tube 12 or other intermediate tube.

The twelfth embodiment shown in FIG. 12 shows embodiment with a base tube 56 that is bent or is made in the shape of "L". An engaging opening 57 is formed at the top end of base tube 56 to connect to tube 12. The other end of base tube 56 is closed or has a venting hole 58 formed thereon.

Thus, these three embodiments, by extending the length of the extension tube, further increase the volume of the speaker cabinet, thereby enhancing the low frequency resonant effect without the need of disposing multiple extension tubes to achieve the same purpose. Speaker cabinet 1 is extended from the embedded cover plate of stationary means 9 to the bottom wall 91 of a second stationary means. Speaker cabinet 1, the base tube, and the intermediate tubes of the connection-type speaker cabinet set forth above are made separately. They can be assembled and installed according to the interior space available in the stationary means. Therefore they are very flexible and adaptable to various environments to improve the sound effect.

The extended speaker cabinet of the present invention, comprising an extension tube, reflecting tube, and base tube, can effectively increase the interior volume of the cabinet, as the interior volume is no longer limited to the cabinet only. As the resonating means are extended, the resonance and over-focused reflection commonly found in rectangular cabinets can be reduced, low frequency distortion will also decrease, and back wave will be eliminated, thus improving overall sound quality and totally eliminate the disadvantages of conventional speaker cabinets.

Many changes and modifications in the above described embodiments of the invention can, of course, be carried out without departing from the scope of the invention. Accordingly, to promote progress in science and the useful arts, the invention as disclosed is intended to be limited only by the scope of the appended claims.

What is claimed is:

1. A tube-annexed speaker cabinet comprising:

a cabinet having an opening formed on a bottom wall with a connecting device being disposed around said opening;

a tube assembly having an upper end that engages with said connecting device; and a supporting pedestal that engages with a lower end of said tube assembly through a second connecting deice such that an effective volume of said speaker cabinet is increased.

2. The speaker cabinet of claim 1 wherein;

said tube assembly comprises a plurality of tube sections.

3. The speaker cabinet of claim 2 wherein;

each said tube section includes a plurality of venting holes.

4. The speaker cabinet of claim 1 wherein;

said supporting pedestal is a plate.

5. The speaker cabinet of claim 1 wherein;

said tube assembly comprises a plurality of venting holes.

6. The speaker cabinet of claim 1 wherein:

said supporting pedestal has an opening on a top surface thereof to form a through connection with said tube assembly.

* * * * *